US005228426A

United States Patent [19]

Pursifull et al.

[11] Patent Number: 5,228,426

[45] Date of Patent: Jul. 20, 1993

[54] OXYGEN SENSOR SYSTEM WITH AN AUTOMATIC HEATER MALFUNCTION DETECTOR

[75] Inventors: Ross D. Pursifull; Julie A. Konrad, both of Dearborn; Robert W. Ridgway, Royal Oak, all of Mich.

[73] Assignee: Ford Motor Company, Dearborn, Mich.

[21] Appl. No.: 967,314

[22] Filed: Oct. 28, 1992

[51] Int. Cl.[5] ..... F02D 41/14

[52] U.S. Cl. ..... 123/690; 123/697

[58] Field of Search ..... 123/479, 690, 697; 60/274, 276; 204/424, 425, 426

[56] References Cited

U.S. PATENT DOCUMENTS

| | | | |
|---|---|---|---|
| 4,724,815 | 2/1988 | Mieno et al. | 123/479 |
| 4,905,469 | 3/1990 | Matsuoka | 60/274 |
| 4,938,194 | 7/1990 | Kato et al. | 123/479 |
| 4,941,318 | 7/1990 | Matsuoka | 60/274 |
| 4,958,611 | 9/1990 | Uchinami et al. | 123/479 |
| 5,054,452 | 10/1991 | Denz | 123/479 |
| 5,090,387 | 2/1992 | Mayer et al. | 123/479 |
| 5,111,792 | 5/1992 | Nagai et al. | 123/697 X |
| 5,148,795 | 9/1992 | Nagai et al. | 123/697 |

*Primary Examiner*—Willis R. Wolfe

*Attorney, Agent, or Firm*—Roger L. May; Lorraine S. Melotik

[57] ABSTRACT

A heated exhaust gas oxygen sensor assembly that automatically detects whether the heater in the assembly is malfunctioning. The assembly includes an oxygen sensor, heater, impedance sensor, and controller. The oxygen sensor detects the relative oxygen concentration in the exhaust gas of an internal combustion engine and issues signal along a pair of output leads. The heater physically warms the oxygen sensor. The impedance sensor is interconnected to the output leads of the oxygen sensor and provides an impedance measurement to the controller. The controller compares the impedance to a predetermined threshold value to judge the effect of the heater in physically warming the sensor. If the impedance is above a predetermined threshold, the controller determines that the heater is not operating properly and issues an alarm signal.

6 Claims, 7 Drawing Sheets

42
54
76
74
78
38
HEGO SENSOR
SWITCH
80
INTERFACE
ENGINE CONTROLLER
82
56

76
84
42
54
V
86
78
38
HEGO SENSOR
88
INTERFACE
ENGINE CONTROLLER
56

42
54
94
92
78
38
A.C. CURRENT SOURCE
HEGO SENSOR
INTERFACE
ENGINE CONTROLLER
56

KEY ON, ENGINE OFF RECORD COOLANT TEMP AND HEGO IMPEDANCE
100
COMMAND HEGO HEATER "ON"
102
RECORD HEGO IMPEDANCE VS. TIME TRACE DURING START-UP
104
106
LOOK UP THRESHOLD TRACE FOR GIVEN SPEED LOAD INITIAL COOLANT TEMPERATURE CONDITIONS
108
ACTUAL < THRESHOLD ?
NO
112
HEATER MALFUNCTION INDICATED
YES
HEATER FUNCTIOIIING PROPERLY
110

OXYGEN SENSOR SYSTEM WITH AN AUTOMATIC HEATER MALFUNCTION DETECTOR

RELATED APPLICATION

The present patent application relates to another U.S. patent application Ser. No. 967,342, still pending, entitled Oxygen Sensor System with a Dynamic Heater Malfunction Detector, which has been filed on the same day as the present patent application and which has the same inventors as the present patent application. The disclosure of this related application is incorporated herein by reference.

BACKGROUND OF THE INVENTION

The present application relates generally to oxygen sensor systems that are frequently found within the exhaust systems of automotive vehicles and, more particularly, to an automatic malfunction detector for a heater within a Heated Exhaust Gas Oxygen ("HEGO") sensor assembly. Many automotive vehicles include an internal combustion engine and an exhaust system that provides a conduit for exhaust gas to move away from the engine. The temperature of the exhaust gases ranges from ambient temperature, when the engine has not been in operation recently, to 400° Celsius ("C.") or more.

A HEGO sensor assembly includes a sensing element and an associated pair of electrical output leads, as well as the heater. The sensing element is placed in the stream of exhaust gas passing through the exhaust system. The HEGO sensor then detects the oxygen level after equilibration and provides an electrical signal on the pair of output leads. The signal on the output leads may then be used, for example, by the vehicle's fuel delivery system to adjust the air/fuel mixture being provided to the combustion chambers of the vehicle's engine.

The HEGO sensor should detect the oxygen level in the exhaust gas, where the temperature of the gas varies over a wide range. To assist the HEGO sensor in making accurate measurements over a wide range of exhaust gas temperatures, a HEGO sensor assembly generally includes an electrical heater physically adjacent, or near, the HEGO sensor. When actuated, the electrical heater warms the HEGO sensor to enable it to make more accurate measurements, and thus lower its sensitivity to the temperature of the exhaust gas.

Prior art systems exist for detecting faults in a HEGO sensor assembly. For example, U.S. Pat. No. 4,958,611, issued to Uchinami et al., relates to an air-fuel ratio controller of an internal combustion engine. The patent discloses a system having a HEGO sensor and a heater. The patent further discloses that the heater's resistance may be measured and compared with a range of acceptable resistances to determine whether the internal resistance of the heater is within an accepted range.

Since HEGO sensor assemblies are generally mass-produced and put on many cars, even a small savings on one part of the assembly can accumulate to substantial annual savings for a car manufacturer. Moreover, it is important that a HEGO sensor assembly, and the fault detection system within such an assembly, be reliable. Further, in many applications, it is desirable to have the HEGO sensor assembly automatically detect the effectiveness of the heater operation soon after the assembly begins operation, without the need for controls to adjust the operation of the heater.

Unfortunately, many presently available systems require the use of additional components to measure a heater's effectiveness, thus increasing the cost and complexity of the HEGO sensor assembly. Other devices only indirectly determine whether the heater of a HEGO sensor assembly is functioning correctly.

Still other devices do not automatically detect the HEGO sensor heater operation upon start-up. Others require controls to turn the heater on and off in order to test the heater, thus further increasing the cost and complexity of the HEGO sensor assembly.

SUMMARY OF THE INVENTION

The present invention is a heated exhaust gas oxygen sensor assembly for an internal combustion engine having an oxygen sensor, heater, impedance sensor, and controller. The oxygen sensor has a sensing element and associated pair of output leads. The oxygen sensor detects oxygen with the sensing element and responsively issues an equilibrated oxygen level signal along the pair of output leads. The heater physically warms the sensor assembly, to enable it to better detect the oxygen level.

The impedance sensor is interconnected to the pair of output leads of the oxygen sensor. The impedance sensor detects the impedance between the output leads and issues an impedance signal representative of the impedance. The controller receives the impedance signal and issues a heater malfunction signal if the impedance is greater than a predetermined threshold.

In another embodiment, the present invention is a process for determining whether a heater in such a HEGO sensor assembly has malfunctioned. The process includes the steps of measuring the impedance between the output leads and issuing a heater malfunction signal when the heater impedance is more than a predetermined threshold.

BRIEF DESCRIPTION OF THE DRAWINGS

Preferred embodiments of the present invention are described herein with reference to the drawings wherein.

DETAILED DESCRIPTION OF THE PREFERRED EMBODIMENTS

Figure 1:
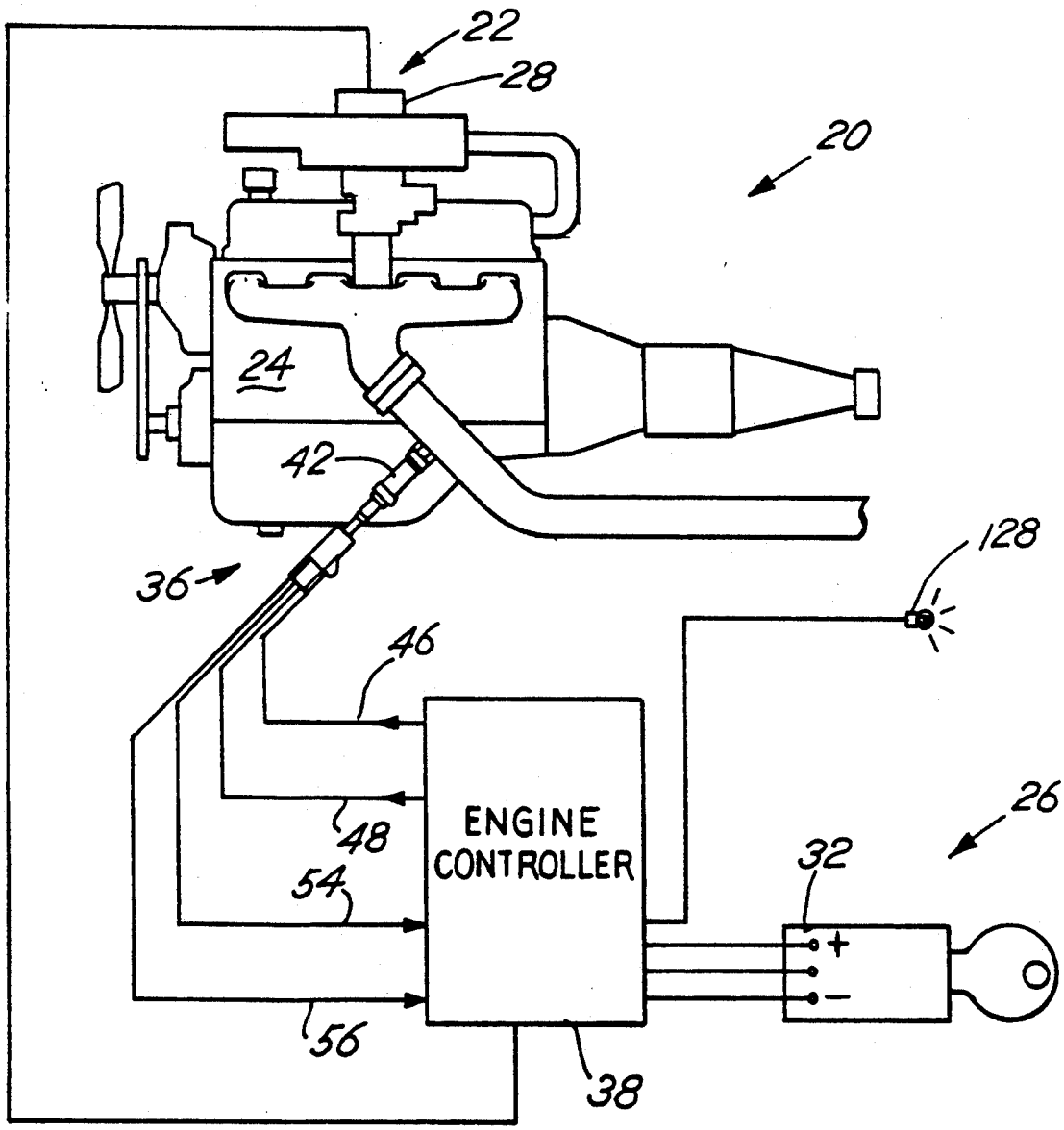
FIG. 1 is a diagram of a HEGO sensor assembly interconnected to the exhaust system of an internal combustion engine.
Figure 2:
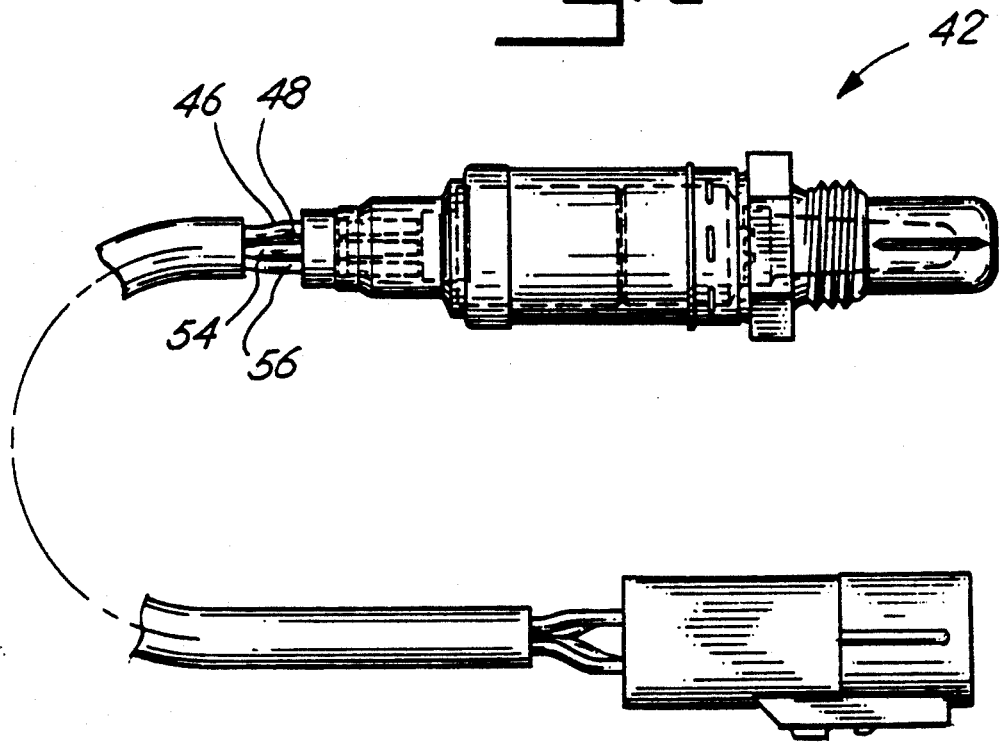
FIG. 2 is a side view of the HEGO sensor assembly shown in FIG. 1.
Figure 3:
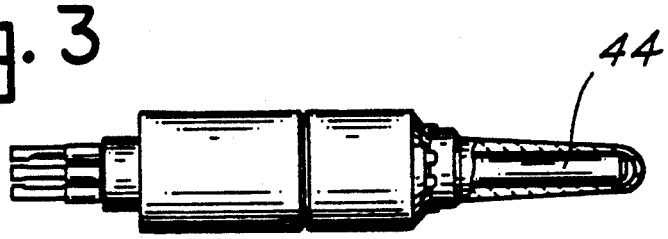
FIG. 3 is a partial cross-sectional view of the HEGO sensor assembly shown in FIG. 2.
Figure 4:
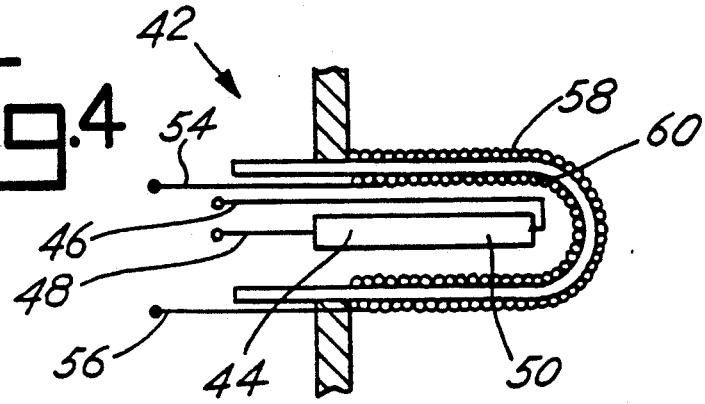
FIG. 4 is a simplified representation of the HEGO sensor assembly shown in FIG. 3.

Referring to FIGS. 1-11, a preferred embodiment of the present invention as shown as a HEGO sensor system 20 for use with an internal combustion engine 22. As shown in FIG. 1, the engine 22 includes an engine block 24 having internal cylinders (not shown), in which combustion takes place, a crankshaft (not shown), an ignition system 26, a fuel delivery system 28, and an exhaust system 30.

The power control 26 includes an power switch 32 that may be manually rotated to first and second positions. For example, when the engine 22 is off, no internal combustion is occurring within the engine 22, and the crankshaft is stationary. When the power switch 32 is turned to a first position, the engine 22 may be considered as being in an initial state, since electrical power is supplied to electrical components of the engine 22, but no combustion is occurring within the engine 22. The power switch 32 may then be rotated to a second position, such that combustion begins within the engine 22. Alternatively, the engine 22 may, for example, be considered to be in an initial position only after the crankshaft begins rotating.

The exhaust system 30 includes an exhaust pipe 34, to carry exhaust gas away from the engine 22, as well as a HEGO sensor assembly 36. As now defined, the exhaust system 30 further incorporates an engine controller 38. One of the functions of the engine controller 38 is to act as an electrical power control. The HEGO sensor assembly 36 includes a HEGO sensor 42 as well as a heater 44 within (or adjacent) the HEGO sensor 42. See FIGS. 2-4.

The heater 44 includes first and second terminals 46, 48 interconnected to a resistive element 50. In one preferred embodiment, the resistive element 50 is ceramic with metal, resistive, heating fragments imbedded in the ceramic. Power is supplied from the controller 38 to the HEGO heater 44. Approximately 12 volts are applied across the heater terminals 46, 48, under normal operating conditions, such that the heater 44 begins heating the nearby HEGO sensor 42. The voltage is typically first applied when the power switch 32 is rotated to place the engine 22 in an initial condition and turn the engine 22 on. The heat produced allows the HEGO sensor 42 to operate more effectively.

The HEGO sensor 42 includes a sensor tip, or "electrolyte" or "sensing element," 52 and first and second output leads 54, 56. The tip 52 is encased in a protective canister 58, which is screwed into the exhaust pipe 34. The tip 52 contacts gas flowing through the exhaust pipe 34 and detects the exhaust gas composition. In the preferred embodiment, the tip 52 detects the level of oxygen in the gas, and provides an oxygen level signal along the pair of output leads 54, 56 qualitatively representing the oxygen concentration. The signal from the HEGO sensor 42 may be received by the engine controller 38 to influence operation of, for example, the fuel delivery system 28, which may adjust the air/fuel mixture being supplied to the cylinders of the engine 22.

The tip 52 is typically comprised of zirconia dioxide ($ZrO_2$). Zirconia dioxide is particularly suited for oxygen sensing, because of its low electrical conductivity and high oxygen ionic conductivity. The tip 52 is typically surrounded on both the interior and exterior surfaces with porous platinum electrodes 60, 62. The lead 54 is interconnected to the interior platinum electrode 60, while the lead 56 is interconnected to the exterior platinum electrode 62.

The tip 52 provides a voltage differential between the two leads 54, 56 relating to the amount of oxygen adjacent the tip 52. The voltage potential is created by the diffusion of oxygen ions through the ceramic. The lattice structure of $ZrO_2$ has a high concentration of oxygen, compared to the adjacent exhaust gas. Oxygen ions migrate from the inner $ZrO_2$ lattice to the exhaust and reference boundaries. An electrical potential develops from the ionic concentrations, which balance the diffusion potential. High electrical resistance maintains the electrical potential, impeding the backflow of electrons that would neutralize the electrical potential.

The impedance between the leads 54, 56 is a combination of electrical and ionic impedances. A model may be used in which both the electrical and ionic impedances are deemed parallel to each other. The electrical impedance remains high and relatively stable over the temperature range generally of interest in the present invention. Thus, ionic impedance dominates the overall sensor impedance.

Applicants have noted that the overall sensor impedance is dependent substantially on the temperature of the sensor tip 52. This results because temperature primarily effects the $ZrO_2$ conductivity. Oxygen ions are released from the $ZrO_2$ lattice by the following equation:

$ZrO_2$+thermal energy results in $Zr^{4+}+O_2^{--}$. The $ZrO_2$ output voltage is generated as a result of the free $O_2^{--}$ ions. At a low temperature, however, an effective increase in the ionic impedance occurs from the lack of available oxygen ions.

Applicants have observed that, substantially independent of the oxygen level signal supplied along the pair of output leads 54, 56 by the HEGO sensor 42, the impedance between the output leads 54, 56 of the HEGO sensor 42 is substantially directly related to the temperature of the HEGO sensor 42. Thus, the impedance is substantially directly related to whether or not the heater 44 is satisfactorily performing its function of physically heating the HEGO sensor 42.

Figure 5:
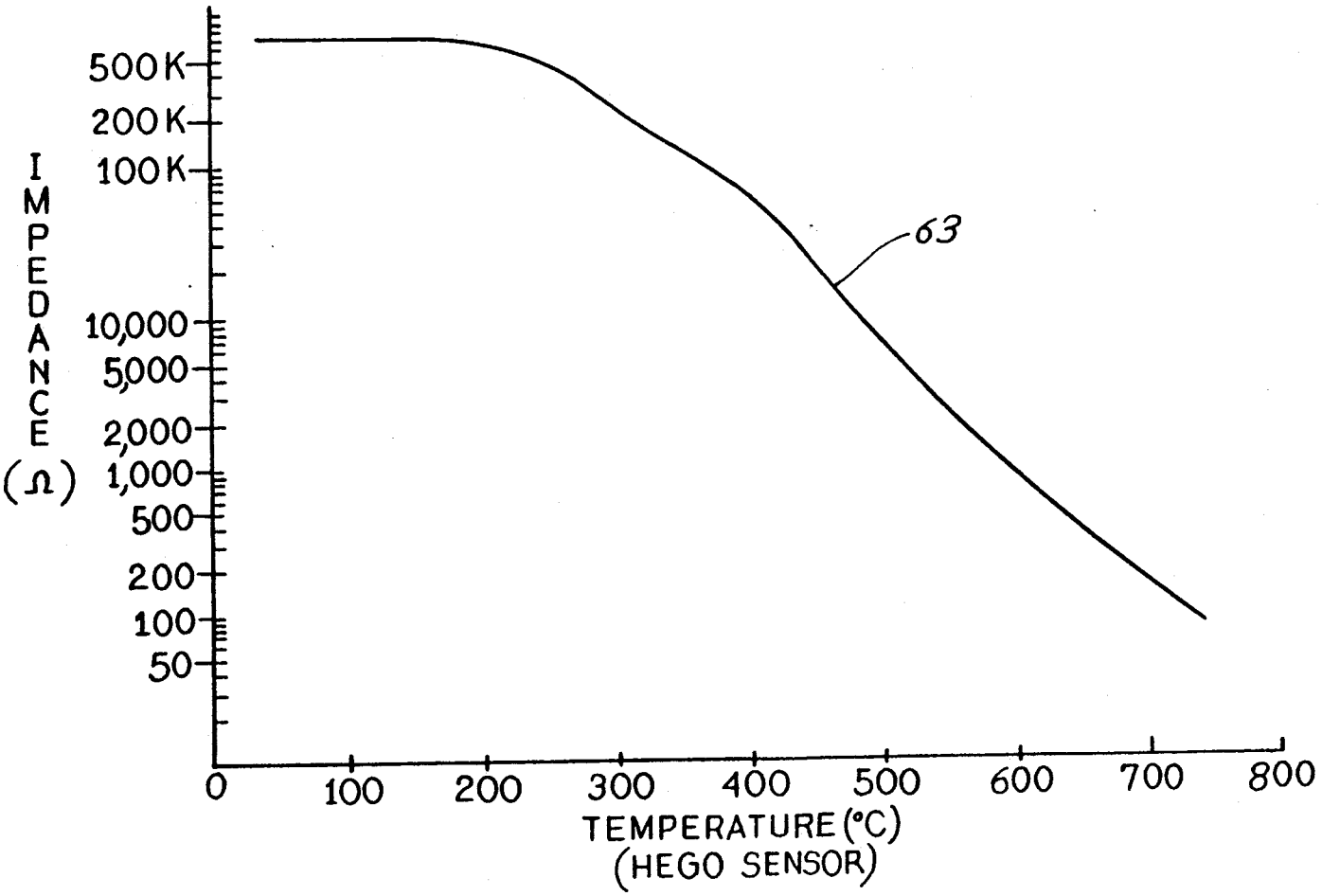
FIG. 5 is a graph showing experimentally measured impedance characteristics, relative to temperature, of a HEGO sensor, such as the sensor shown in FIG. 2.

As shown in FIG. 5, experimentally derived data 63 indicate that the impedance of the HEGO sensor 42 varies substantially directly with its temperature. Thus, for example, a HEGO sensor at a temperature of, for example, 500° C. exhibits an impedance between the pair of output leads 54, 56 of approximately 5 kilohms, while a HEGO sensor at a temperature of 200° C. exhibits an impedance of approximately 500 kilohms.

Accordingly, the present invention relates to measuring the impedance between the output leads 54, 56 of the HEGO sensor 42 itself to make a determination as to whether or not the heater 44 is satisfactorily performing its function. The testing of the heater's performance is substantially independent of the oxygen level signal along the HEGO sensor's output leads 54, 56 or the electrical signal along the heater terminals 46, 48 or the internal resistance of the HEGO heater 44. Moreover, with the present invention, the effect of the heater 44 is directly sensed rather than, for example, performing a diagnostic to ensure, for example, that the HEGO heater 44 does not have an internal short circuit or open circuit.

Figure 6:
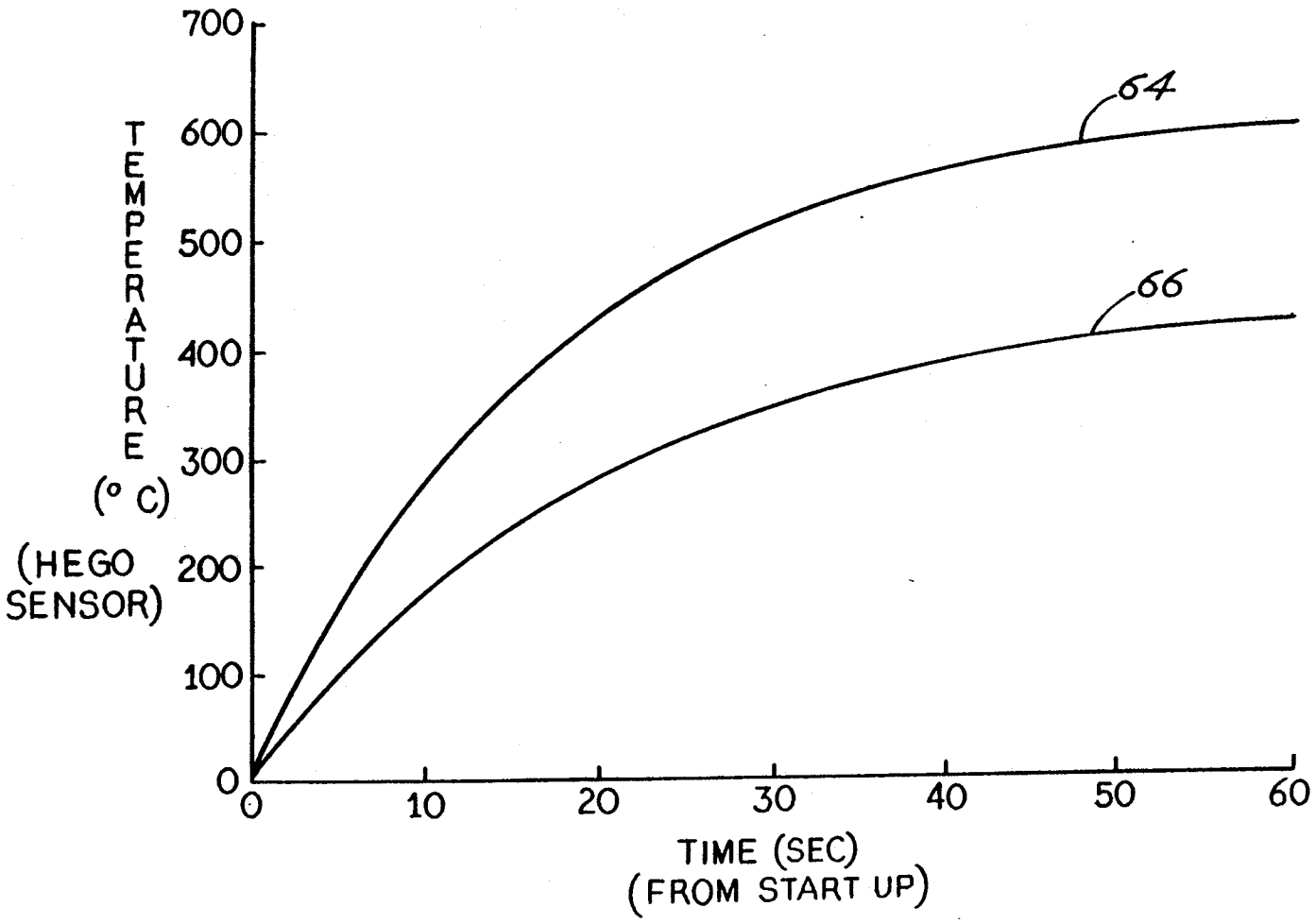
FIG. 6 is a graph showing experimentally measured temperature characteristics of a HEGO sensor, such as the sensor shown in FIG. 2.

After the engine 22 begins operation (such that the internal combustion occurs within the engine block 24 and the crankshaft rotates), the temperature of the exhaust gas in the exhaust pipe 34 increases. FIG. 6 shows experimentally derived data regarding the temperature of the HEGO sensor 42 after an automotive engine 22 has first started. A graph 64 shows the HEGO sensor temperature when the heater 44 is functional, and a graph 66 shows the HEGO sensor temperature when the heater 44 is not functional. The HEGO sensor temperature rises more quickly, and moves to a higher level, when the heater 44 is functioning. Thus, in order to detect a heater malfunction, the sensor assembly 36 makes use of the observation that a HEGO sensor temperature will vary substantially, after only a few seconds of engine operation, depending on whether or not the heater 44 is operational.

Figure 7:
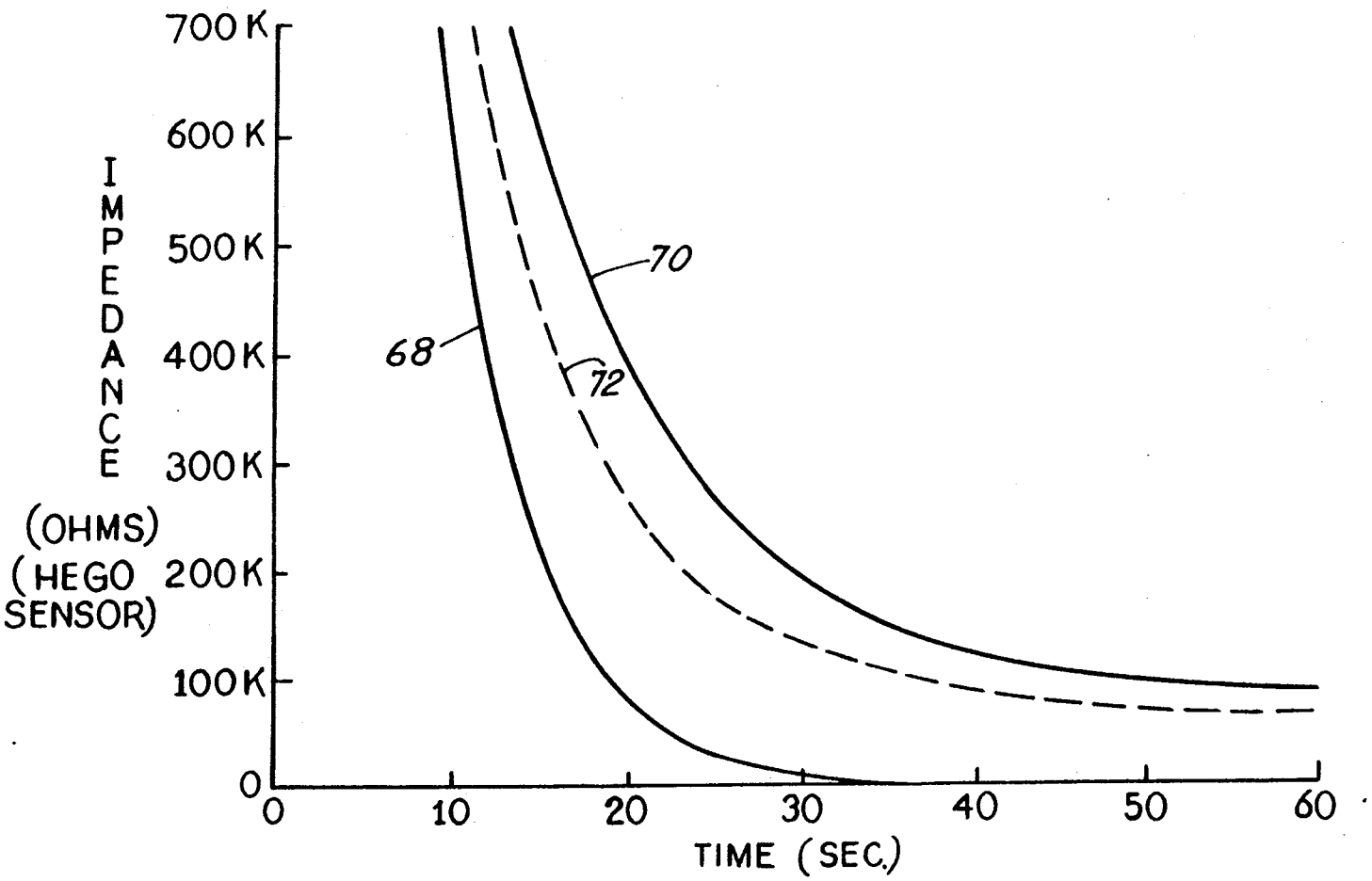
FIG. 7 is a graph showing experimentally measured impedance characteristics, over time, of the HEGO sensor, such as the sensor shown in FIG. 2, with the HEGO heater both operable and inoperable.

FIG. 7 shows experimentally derived plots of a HEGO sensor's impedance, over time, after an engine has started. FIG. 7 shows how the impedance between the leads 54, 56 varies after the engine 22 is turned on. Line 68 shows the impedance when the heater 44 is functioning. Line 70 shows the impedance when the heater 44 is not functioning.

Thus, for example, after the engine 22 has been operating for approximately twenty seconds, the HEGO sensor tested with a functioning heater had an impedance of approximately 100 kilohms. The HEGO sensor with the heater not functioning after twenty seconds of engine operation had an impedance of approximately 400 kilohms.

A third, threshold line 72 is shown in FIG. 7. The threshold line 72 shows a boundary that may be used for decision-making in the sensor assembly 36 regarding whether or not the heater 44 is functioning. Thus, for example, in one application, the engine 22 and heater 44 begin operation at approximately the same time. After thirty seconds of engine operation, the HEGO impedance may be measured. If the impedance is "low," the sensor 42 probably has been warmed, and the heater 44 may be determined to be functioning. Conversely, if the impedance is "high," the sensor 42 has probably not been sufficiently warmed, indicating that the heater 44 is malfunctioning. The threshold line 72 provides a benchmark to store in the memory of a control device to enable a decision to be made.

According to one embodiment of the present invention, when the measured impedance between the leads 54, 56 is below the threshold line 72 after a predetermined "interval" after start up of the engine 22 (such as 20 or 30 or 40 seconds), the heater 44 is deemed to be functioning within acceptable limits. Otherwise, the heater 44 is deemed to be malfunctioning, and an alarm signal issues. The alarm signal may be utilized to, for example, light a dash-mounted warning light or initiate another warning device. The "interval" referred to above may correspond to a period of time or, for example, a delay necessary for an engine operating parameter (such as coolant temperature or exhaust gas temperature) to reach a particular level.

Figure 8:
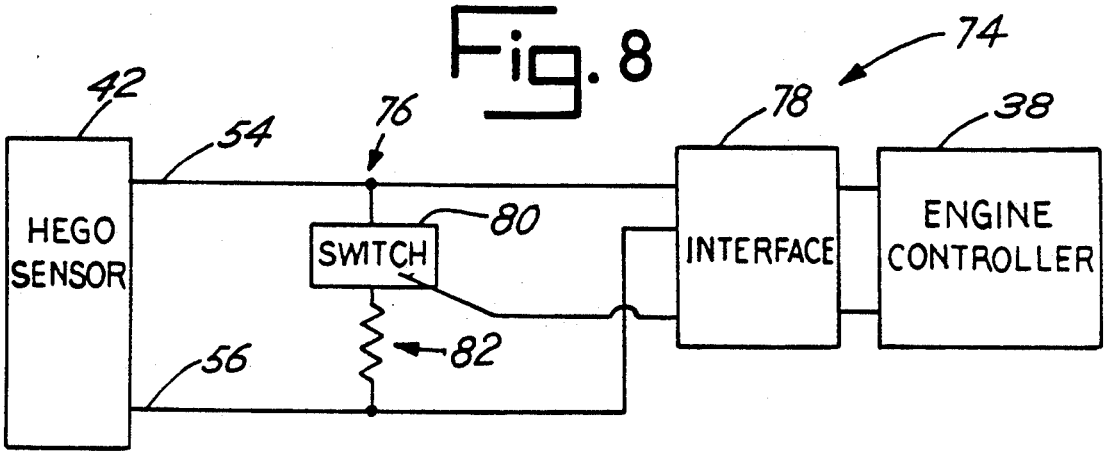
FIG. 8 is a schematic diagram of a preferred embodiment of the present invention utilizing the HEGO sensor shown in FIG. 2.
Figure 9:
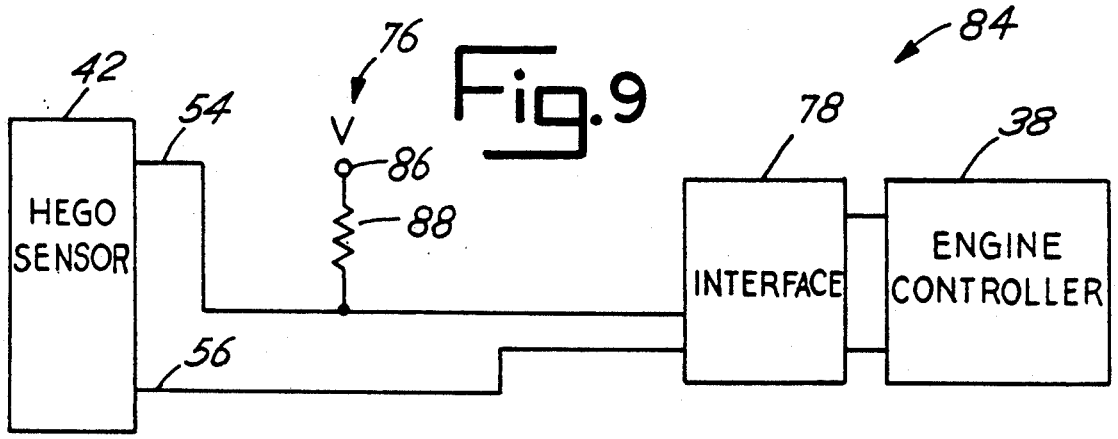
FIG. 9 is an alternative embodiment of the invention shown in FIG. 8.
Figure 10:
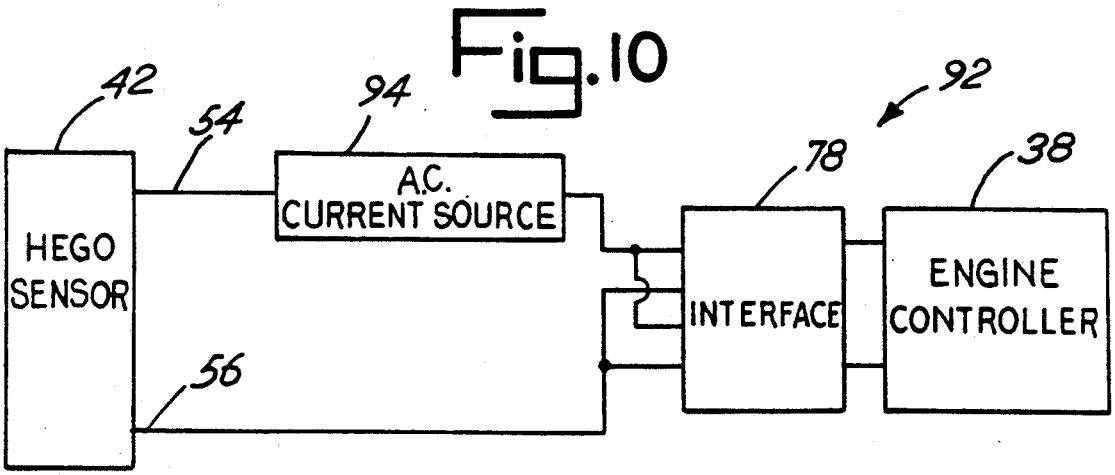
FIG. 10 is an alternative embodiment of the invention shown in FIGS. 8 and 9.

Physical devices for implementing the invention are shown, for example, in FIGS. 8–10. An apparatus 74 is shown in FIG. 8 which includes the HEGO sensor 42 having the first and second leads 54, 56, an assembly 76, microcontroller interface 78, and the microprocessor-based engine controller 38. The assembly 76 includes a switch 80, receiving input from the controller 38, and a load resistor 82 interconnected in series with the switch 80 between the leads 54, 56. The leads 54, 56 supply an analog signal to the controller 38 through the interface 78. The analog signal represents the oxygen level sensed by the HEGO sensor 42 in the exhaust pipe 34.

The switch 80 receives an input from the controller 38 to close, putting the load resistor 82 into the circuit, or to open, taking the load resistor 82 out of the circuit. The controller 38 may then measure the current through the sensor 42 with the load resistor 82 both in and out of the circuit and, thus, determine the impedance between the leads 54, 56. This is done with the engine exhaust made rich, i.e., with the HEGO voltage at approximately 1 volt.

In an alternative embodiment shown in FIG. 9, the apparatus 84 shown includes the HEGO sensor 42, assembly 76, interface 78, and controller 38. However, the assembly 78 includes a reference voltage source 86 and a dividing resistor 88. The controller 38 may then measure the voltage drop between the leads 54, 56, compare this voltage with the reference voltage of the source 86, and accordingly determine the impedance between the leads 54, 56.

Alternatively, as shown in FIG. 10, an apparatus 92 includes an Alternating Current source 94. The interface 78 receives both a substantially Direct Current voltage input, so that the controller 38 may determine the oxygen level, and an Alternating Current voltage, so that the controller 38 may determine the impedance between the leads 54, 56. In the preferred embodiments, the internal impedance of the sensor 42 (measured between the leads 54, 56) has been measured at both 100 hertz and 10 kilohertz.

Figure 11:
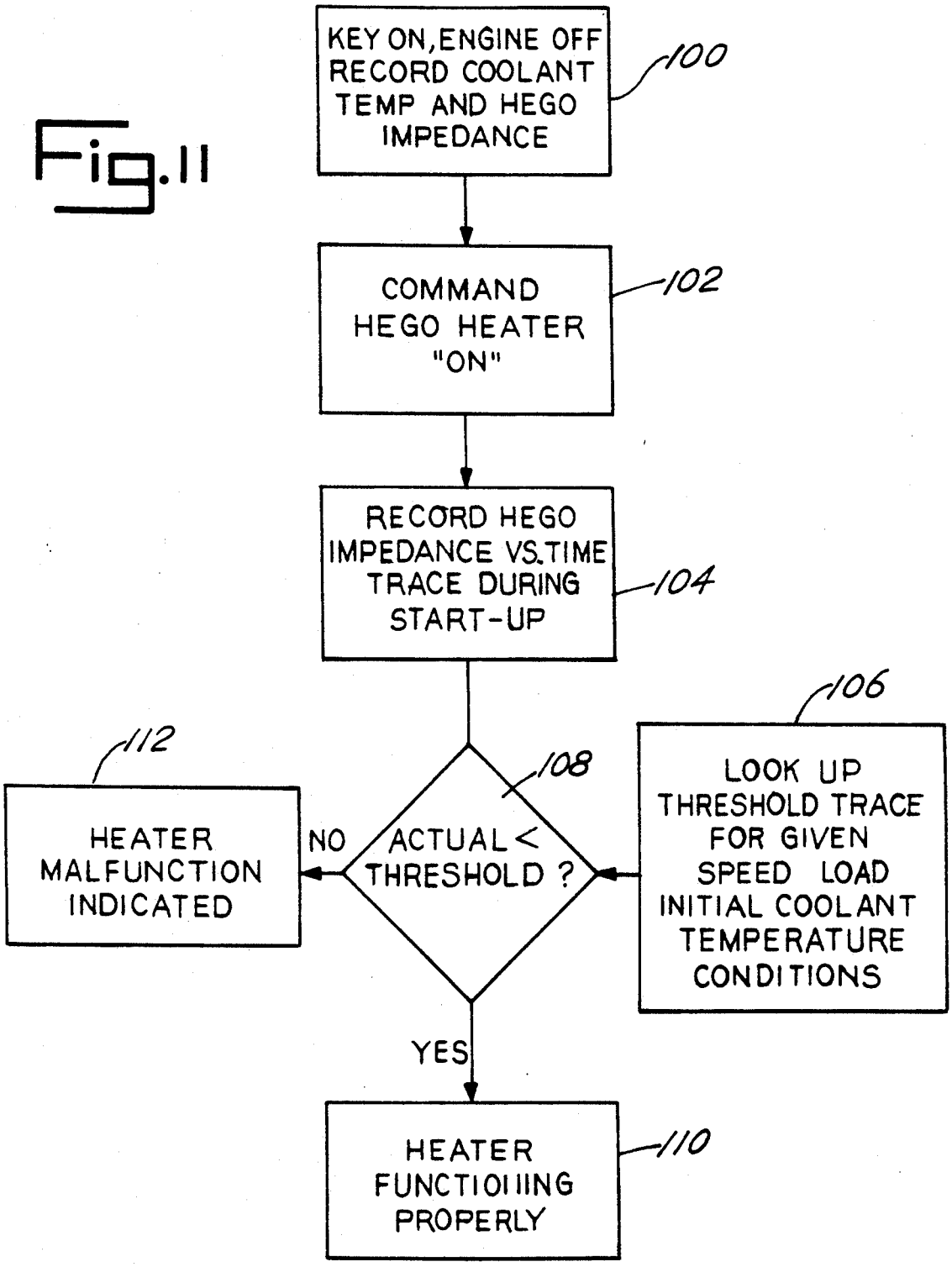
FIG. 11 is a flow chart showing the process used by the embodiments shown in FIGS. 8-10.

The process followed by the apparatus 74, 84, and 92 shown in FIGS. 8–10 is shown in the flow chart of FIG. 11. Initially, the engine 22 is not operating, with the crankshaft substantially stationary and the power switch 32 in an off position. Next, at step 100, the power switch 32 is turned to a first position. In this case, the power switch 32 functions as an initiation detector (or "timer") to sense the initial state of the engine 22. This initial supply of electrical power may be considered an initiation signal (or "timing signal") detected by the controller 34 and heater 44.

The controller 38 may then record initial parameters of the engine 22, including, for example, its coolant temperature and the HEGO sensor 42 impedance. The parameter(s) thus measured may be stored in a memory of the controller 38.

At step 102, the controller 38 activates the HEGO heater 44, such that it begins heating the HEGO sensor 42. At step 104, the HEGO sensor impedance is periodically measured by the controller 38, and the results are stored in memory. In another embodiment, the controller 34 may then also periodically measure, and store in memory, operating parameters experienced by the engine 24, such as speed and load.

After counting a predetermined time threshold, such as, for example, thirty seconds, the controller 34 takes, from memory, at step 106, a threshold "trace" or "profile" for given parameters, such as speed, load, and/or initial coolant temperature, that the engine 22 experienced. At step 108, the controller 34 makes a determination of whether or not the measured impedance is greater or less than the threshold retrieved from memory.

If, for example, the predetermined time interval is thirty seconds and the trace retrieved from memory is similar to that shown in FIG. 7, a threshold value, such as 150 kilohms, may be recalled out of memory. If, at step 108, the sensor HEGO impedance is found less than the threshold value, the controller 34 determines, at step 110, that the HEGO sensor heater 44 is operational and no further action need be taken by the controller 34. If, however, as shown at step 112, the HEGO sensor impedance is above the threshold value, a heater malfunction is indicated, and the controller 34 issues a heater malfunction signal.

A heater malfunction signal, or alarm, may simply be a signal to illuminate a light 114 on the dashboard (see FIG. 1) to indicate to the operator of the vehicle that the heater 44 is malfunctioning. Of course, the malfunction signal from the controller 34 may be used in a variety of other ways to otherwise alert a driver or mechanic that the heater 44 has malfunctioned.

Other variations of the present invention will be readily apparent to those of ordinary skill in the art of exhaust gas sensor design. The present invention directly measures the effect of the operation of the heater 44 by measuring the internal impedance of the sensor 42. A single impedance measurement may be made, after a predetermined time interval, to determine whether the impedance is below a particular threshold. No adjustment of the heater 44 is required. The determination may be made "automatically" after the engine 22 (and heater 44) begin working.

In another embodiment, the controller 34 receives initiation signal, from the power switch (or other device), to indicate that the engine 22 is about to begin operation, or has only been recently been operating, or that the HEGO heater 44 is about to be activated, or has recently been activated. The controller 34 may then simply periodically measure the impedance between the leads 54, 56, and measure the time necessary for the impedance to reach a predetermined impedance level, such as, for example, 150 kilohms. If the time exceeds a predetermined interval, such as, for example, thirty seconds, then the controller 34 may determine that the HEGO heater 44 is not functioning.

In still another embodiment, the controller 38 does not need to periodically measure the impedance of the HEGO sensor, but simply measures the sensor impedance after the controller 38 receives an indication that a properly functioning heater 44 should have warmed the sensor 42. Such an indication may come, for example, from a controller that has monitored the engine's recent, historical speed and load. The engine's coolant temperature or exhaust gas temperature may also be used. The controller 34 then measures the HEGO sensor's impedance to determine whether it is above or below the threshold value.

In the embodiments described, the operation of the heater 44 is "automatically" detected. The heater 44 is tested without the need to turn the heater 44 off after it has been turned on or to otherwise interfere with the operation of the HEGO sensor 42.

Preferred embodiments of the present invention have been described herein. It is to be understood, however, that changes and modifications can be made without departing from the true scope and spirit of the present invention. This true scope and spirit are defined by the following claims and their equivalents, to be interpreted in light of the foregoing specification.

We claim:

1. A process for determining whether a heater for an exhaust gas oxygen sensor has malfunctioned, said heater warming said oxygen sensor, and said oxygen sensor detecting oxygen in a sensing element and responsively issuing an oxygen level signal along a pair of output leads, comprising the steps of:

measuring impedance between said output leads of said sensor to arrive at a heater impedance level; and issuing a heater malfunction signal when heater impedance is more than a predetermined threshold.

2. A process for determining whether a heater for an exhaust gas oxygen sensor has malfunctioned, said heater warming said oxygen sensor, and said oxygen sensor detecting oxygen in a sensing element and responsively issuing an oxygen level signal along a pair of output leads, comprising the steps of:

detecting that said engine is in an initial state;

measuring impedance between said output leads of said sensor;

measuring a time interval from detecting that said engine is in an initial state to when said impedance reaches a predetermined level; and issuing a heater malfunction signal when said time interval is greater than a predetermined threshold.

3. A heated exhaust gas oxygen sensor assembly for an internal combustion engine comprising, in combination:

an oxygen sensor, having a sensing element and a pair of output leads, for detecting oxygen with said sensing element and responsively issuing an oxygen level signal along said pair of output leads;

a heater for warming said oxygen sensor;

an impedance sensor, interconnected to said pair of output leads, for detecting impedance between said output leads and issuing an impedance signal; and a controller, interconnected to said impedance sensor, for issuing a heater malfunction signal when said impedance exceeds a predetermined standard.

4. An assembly as claimed in claim 3 further comprising an alarm, interconnected to said controller, for receiving said heater malfunction signal and responsively indicating that said heater is malfunctioning.

5. An assembly as claimed in claim 3 further comprising:

an initiation detector for sensing that said engine is in an initial state and issuing an initiation signal, and wherein said controller is interconnected to said initiation detector, said controller accepting said impedance and initiation signals, measuring an interval after receiving said initiation signal for said impedance to reach a predetermined threshold, and issuing a heater malfunction signal when said interval is greater than a predetermined standard.

6. An assembly as claimed in claim 5 further comprising an alarm, interconnected to said controller, for receiving said heater malfunction signal and responsively indicating that said heater is malfunctioning.

* * * * *